US005461976A

United States Patent [19]

Forehand

[11] Patent Number: 5,461,976

[45] Date of Patent: Oct. 31, 1995

[54] POWER DRIVEN SEAL DEVICE

[76] Inventor: Michael E. Forehand, 2525 N. Norwood Pl., Tulsa, Okla. 74115

[21] Appl. No.: 218,579

[22] Filed: Mar. 28, 1994

[51] Int. Cl.[6] ..... B31F 1/07

[52] U.S. Cl. ..... 101/31.1; 101/3.1

[58] Field of Search ..... 101/31.1, 3.1, 101/28

[56] References Cited

U.S. PATENT DOCUMENTS

| | | | |
|---|---|---|---|
| 2,348,566 | 5/1944 | Papazian | 101/3.1 |
| 2,875,684 | 5/1953 | Teel | 101/3.1 |
| 3,033,106 | 5/1962 | Priesmeyer | 101/31.1 |
| 4,476,781 | 10/1984 | Kubacki et al. | 101/3.1 |
| 5,054,389 | 10/1991 | Kuhlman et al. | 101/28 |
| 5,127,320 | 7/1992 | Mei | 101/31.1 |

FOREIGN PATENT DOCUMENTS

| | | | |
|---|---|---|---|
| 0596489 | 3/1978 | U.S.S.R. | 101/3.1 |
| 0883801 | 12/1961 | United Kingdom | 101/3.1 |
| 0953229 | 3/1964 | United Kingdom | 101/3.1 |

*Primary Examiner*—Edgar S. Burr
*Assistant Examiner*—Anthony H. Nguyen
*Attorney, Agent, or Firm*—Catalano, Zingerman & Associates

[57] ABSTRACT

A power driven seal for impressing a design on a sheet of paper. It incorporates a solenoid having a housing and a movable core. A frame supports the housing. A die holder is supported from the movable core and a splash is supported by the frame beneath the die holder. Guide pins extend down from the solenoid housing through holes in the die holder.

6 Claims, 4 Drawing Sheets

POWER DRIVEN SEAL DEVICE

BACKGROUND OF THE INVENTION

This relates to seals for impressing designs, symbols or words used to certify a signature or authenticate a document or signature upon documents and especially upon paper.

Seals for applying an impression onto paper have been known for ages and are used to impress government seals and so forth. One of the most widely used is a notary seal which is hand operated and must be squeezed rather firmly by the operator. The United States has a seal, every state has a seal, and each one of these seals are used for official documents.

There are many devices used for impressing a seal or figure onto a paper or document. One such seal or impression device is shown in U.S. Pat. No. 5,054,389 entitled: "Unitary Paper Impression Device." That device includes a male embossing section which has a contacting face surface and also includes a female embossing section which has a contacting face surface for receiving the projections of the male embossing section. When the two sections are pressed together with paper between them, an image is impressed thereon.

All of the paper impression devices for embossing a seal on paper or documents of which I am aware are hand powered. Therefore, there is a need for a reliable, simple operated power driven seal device.

BRIEF SUMMARY OF THE INVENTION

This is a power driven seal device for embossing paper or other documents with a seal or impression. It includes a frame having an upright member and a lateral member for sitting on a desk. It has a solenoid with a housing and a movable core. The housing of the solenoid is supported from the upright member. The movable core is connected by a drive pin to a die holder which includes the die which determines the impression. Directly beneath the die holder and supported on the lateral member of the frame is a "splash" which is aligned so that when the solenoid is activated, the die and splash intermesh so that the seal (or design impression or desired form) is embossed or impressed upon the paper. Sometimes, as is done in the U.S. Pat. No. 5,054,389 patent, the die may be referred to as a female embossing section, and the splash as the male embossing section. The term "die" could broadly include both male and female embossing sections. However, here the term "die" refers primarily to the embossing section in the movable die holder, and the term splash refers to the lower or non-moving embossing section. Biasing means are provided to return or raise the die holder off the paper when the power is cut off to the solenoid. In one embodiment return springs are connected between set screws drilled into the die holder at one end and the top of the solenoid housing. It is also important to guide the die holder so it will align perfectly with the splash. This is accomplished by having holes in the die holder and guide pins supported from the solenoid housing. These guide pins extend through those holes. Then the die holder always moves in a set path.

In operation the paper to be embossed with the seal is placed beneath the die of the die holder, and on top of the splash. When the paper is in the proper position, the solenoid is activated. This drives the die holder downwardly with great force against the paper so that the pattern of the die and the splash is embossed on the paper.

In its second embodiment, the solenoid with the housing and the movable core is attached with its housing bolted to the upright frame. The movable core extends out the top of the solenoid and is connected to a horizontal drive bar which is free to move with the movable core. Extending downwardly at one end of the horizontal vertical drive bar is a vertical drive pin which extends downwardly through a guide bar which is horizontal and parallel to the drive bar at the top. The guide bar is supported from the solenoid body. The lower end of the drive pin is connected to a die holder which is positioned above a splash which is supported on the base of the frame. This embodiment also has means for returning the die to its proper position above the paper so the paper can be removed. In this device the die holder can be spaced quite far from the vertical support frame, i.e. 4 to 6 inches or more and thus permits the die to form a seal or emboss the paper at any desired position on both sides of about any document or paper.

It is thus an object of this invention to provide a power driven seal device which uses a solenoid and is quite simple and reliable. A better understanding of the invention can be had from the following description taken in conjunction with the drawings:

DETAILED DESCRIPTION OF THE PREFERRED EMBODIMENT

Figure 3:
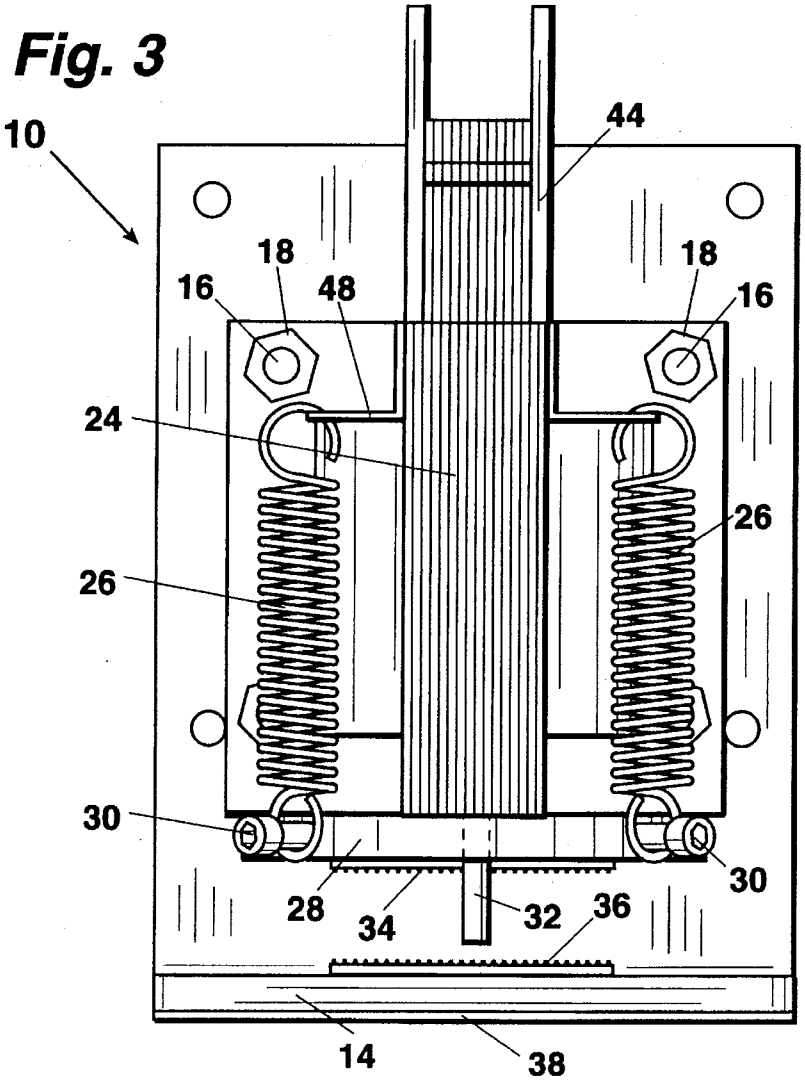
FIG. 3 is taken along the lines 3—3 of FIG. 1, and the view has been rotated 90° from that of FIG. 1.

Attention is next directed to the drawings which show the combination employing a solenoid for activating a power driven seal device. Attention is first directed to FIGS. 1 and 3 which show a solenoid 10 having a movable core 24 and extension 44 within a solenoid housing 20. Solenoids are well known; and by applying electrical current, they can be made to drive the movable core from one position to another position: In this case, from an up position to a down position. There is a frame 12 having an upright member 11 and a base 14. A cushioned pad 38 is on the bottom of base 14.

The solenoid is supported from the frame 12 so that the housing 20 is in a fixed position with respect to the base 14 of the frame. It is held in this position by bolts 16 and nuts 18.

A drive pin 46 is secured to the lower end of movable core 24. This can conveniently be done, for example, by tapping a hole into the bottom of the movable core and attaching the drive pin into it. A die holder 28 is supported below and in contact with the lower end of drive pin 46. The die holder 28 follows the vertical movement of the drive pin 46. When power is supplied to the solenoid, the movable core moves down and with it the drive pin 46 and die holder 28. On the underside of die holder 28 is a female embossing section of die 34 which is secured to the underside of die holder 28. Supported on the upper side of base 14 is a splash or complemental die portion or male embossing section to the die 34 so that when a piece of paper is positioned between splash 36 and die 34, it will be imprinted with the imprint of the die and splash when the solenoid is activated. Ordinarily the female die section and male embossing splash section will be on die holder 28 and base 14 respectively. However, they may be reversed. All that is required is that the two sections cooperate to produce the desired imprintation. The die holder 28 is thus driven by the solenoid to the position shown in FIG. 2 which is the down position and is in the position which causes the seal imprint to be imprinted upon the document as desired.

Figure 1:
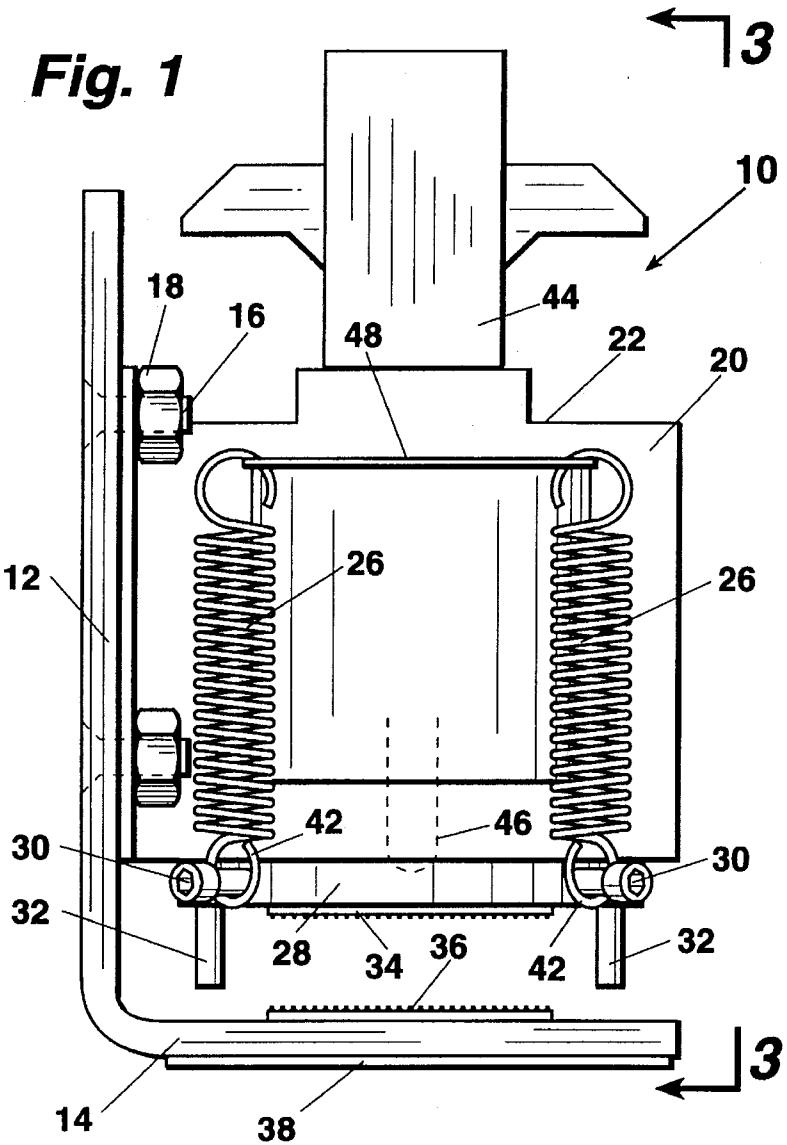
FIG. 1 is a full face side view of the power driven seal device of this invention showing the die holder in an up position.

Biasing means are provided so that the die holder 28 will be returned to the position shown in FIG. 1 when electrical power is cut off to the solenoid. This typically includes two or four return springs 26 which are connected between set screws 30 in the die holder 28 and the top plate 48 to which the springs 26 are connected by hooks 40. The power of the solenoid must be such that when the solenoid is activated it will overcome the resistance of the springs 26 and also force the die holder 28 downwardly with sufficient force to cause the desired imprint of the seal on the document.

Figure 4:
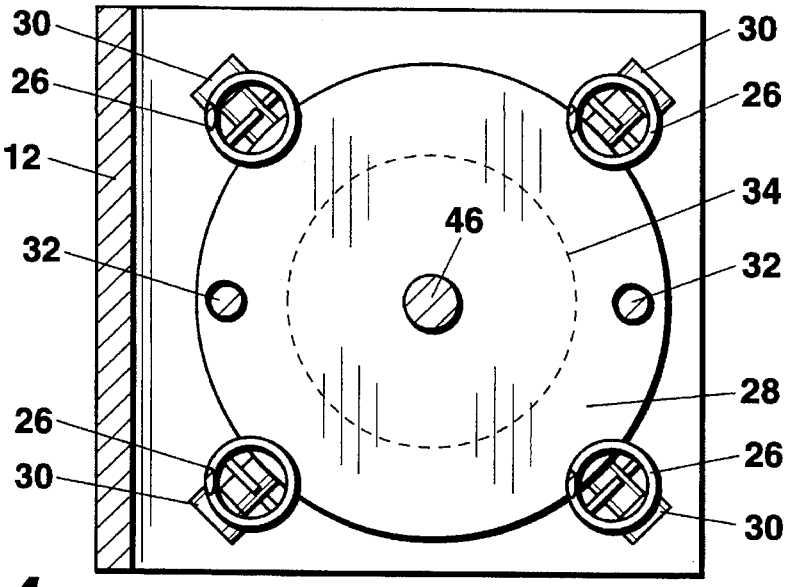
FIG. 4 is a view taken along the line 4—4 of FIG. 2.
Figure 2:
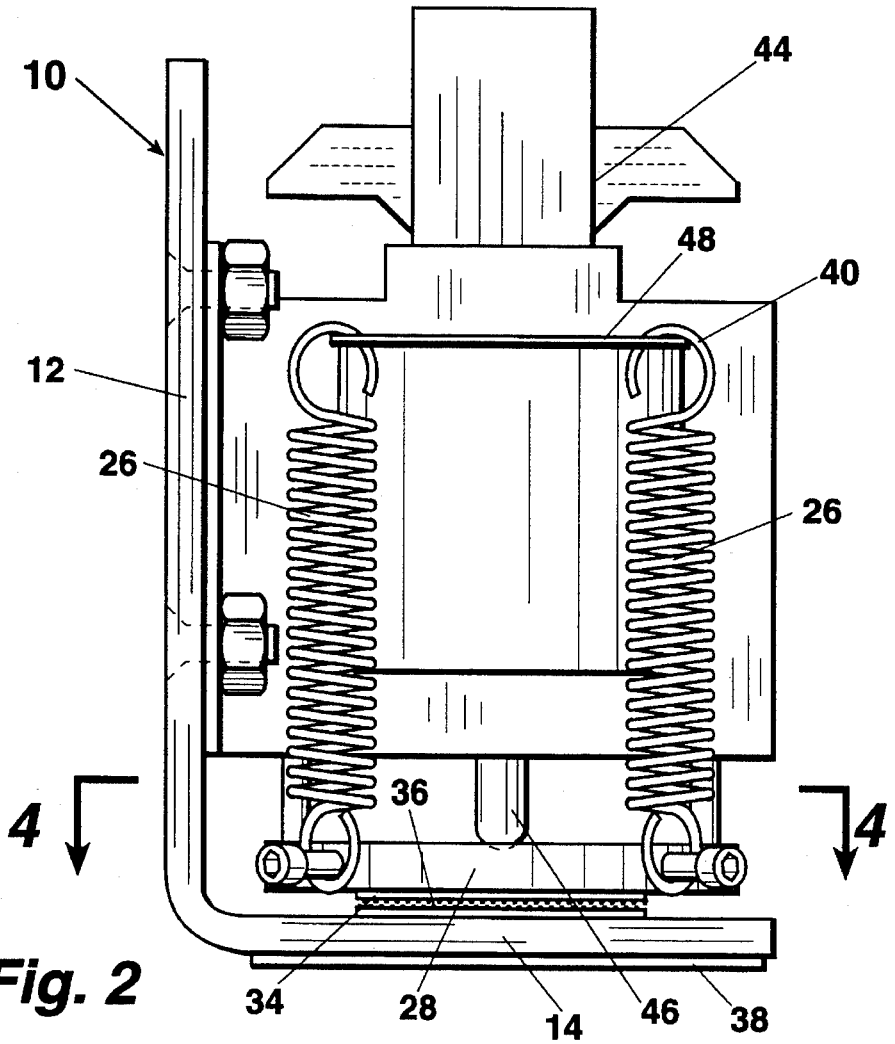
FIG. 2 is similar to FIG. 1 except that the die holder is in its down position.

When the die holder 28 is forced downwardly with fairly rapid velocity, it must be guided in some manner so that the die 34 will mesh precisely with splash 36. The splash 36 and die 34 are imprinted to have the desired seal design when forced together with paper between them. The guide of the die holder is accomplished by having two guides pins 32 which are supported from solenoid housing 20 and slidably extend through holes in die holder 28. There is a small clearance between the guide pins 32 and the hole in die holder 28. This clearance is such as to permit sliding passage of guide pins 32 but small enough to be an effective guide. Thus, when die holder 28 is forced downwardly, it will always take the same path with respect to the base 14 which is part of frame 12 which is fixed to the solenoid housing 20. Inasmuch as it is known what the exact path or positions that the die holder 28 will take when it is driven downwardly with respect to the base 14, the die 34 and splash 36 can be positioned respectively on die holder 28 and base 14 so that they will align properly and assure a clear imprint of the embossed configuration or "seal" every time the solenoid is activated. In FIG. 2 it is shown that the die 34 and splash 36 are meshed properly and shows the relative position of the various components when the solenoid is operated. It should also be noted that preferably there are four springs 26 as shown in FIG. 4 to assure that the solenoid will be retracted to the upper position without binding of the components. It is also shown in FIG. 4 the position of the guide pins 32 so that the die holder 28 will always be taking the same path each time the solenoid is activated.

Figure 5:
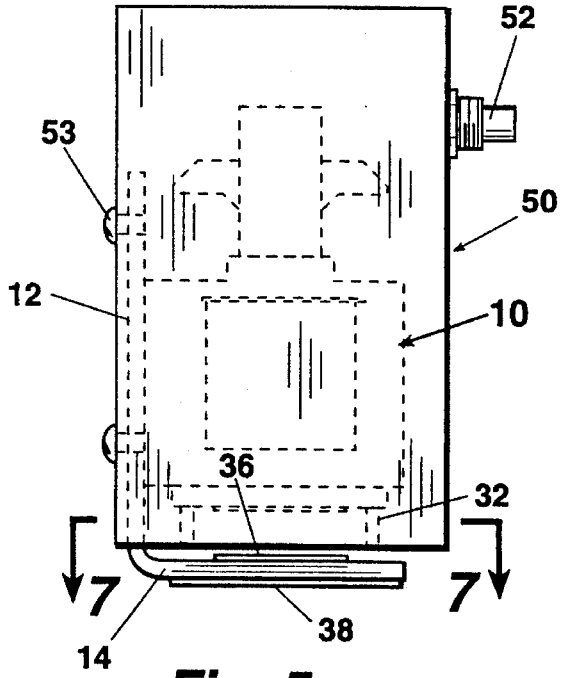
FIG. 5 illustrates the power driven seal of FIG. 1 in a case.
Figure 6:
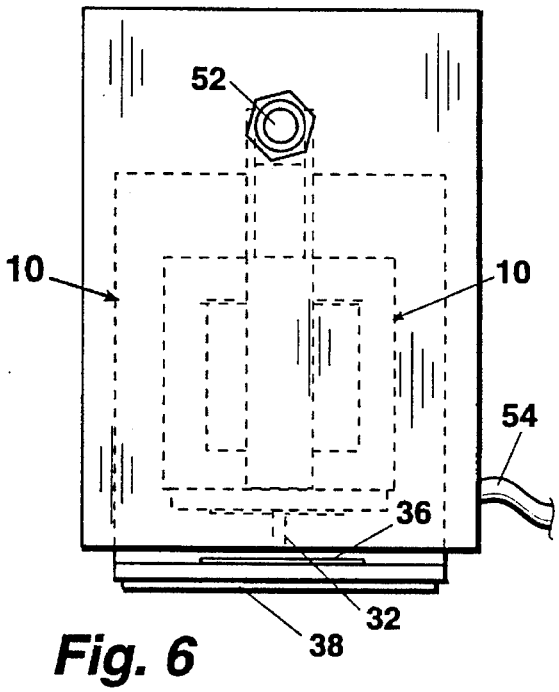
FIG. 6 is a view of the device of FIG. 5 rotated 90°.
Figure 7:
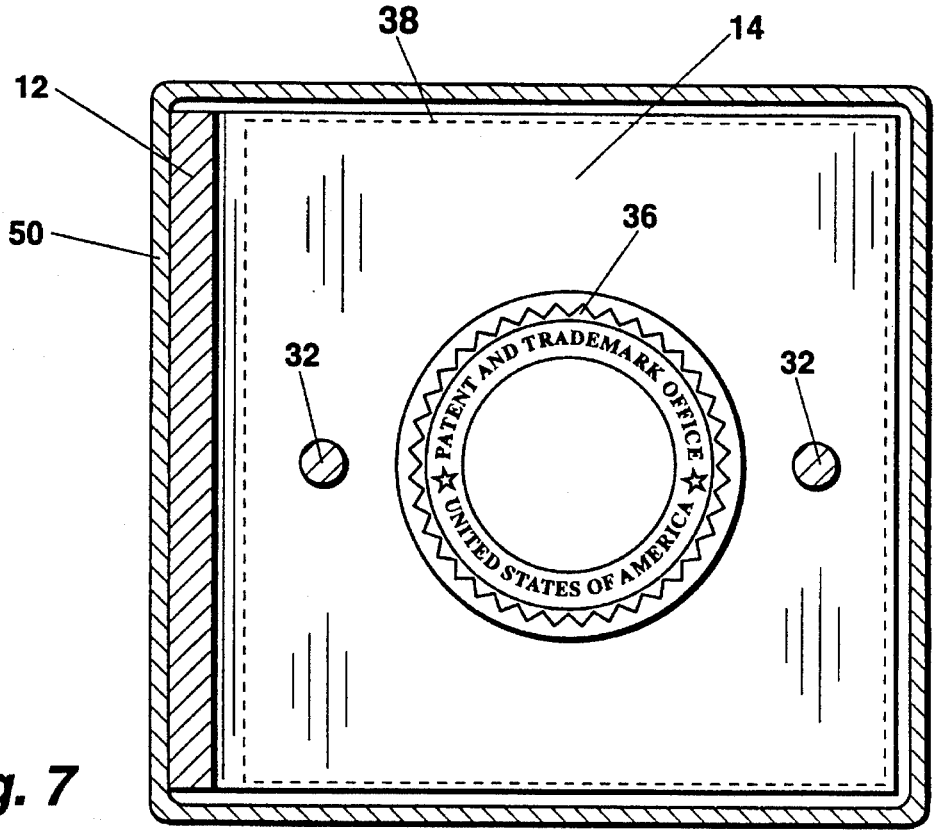
FIG. 7 is view taken along the lines 7—7 of FIG. 5.

Attention is now directed especially to FIGS. 5, 6, and 7. In FIGS. 5 and 6 there is shown a cover 50 placed over the solenoid combination shown in FIGS. 1, 2, 3, and 4. Cover 50 is held to frame 12 by screw 53. A power line 54 is connected to the solenoid in the usual manner, and a switch 52 is provided for turning power to the solenoid on and off. The base 14 is beneath the cover so that sheets of paper can be inserted on top of the base 14. The frame 12 in addition to supporting the solenoid also supports the cover 50. FIG. 7 illustrates the top of base 14 and shows the relative positions of guide pins 32 and the splash 36. It is on top of this that the paper is inserted so that the female die 34 can be forced down on the top side of the paper and together with splash 36 to cause the proper desired imprintation of the seal.

In the operations of the embodiment just described, a sheet of paper which is to be imprinted is inserted into the space as shown in FIG. 1 and the solenoid activated. The solenoid will drive die holder 28 down and cause an imprint between the female die and the splash on the paper inserted. Depending on the power of the solenoid, it will nearly always cause a perfect imprint on the paper commonly used. If the paper is thin, there is no problem. If the paper is rather thick, then one might have to activate the solenoid two times before moving the paper to get the desired imprint. This will probably be unusual to require two activations of the solenoid, because most frequently the power solenoid driven seal combination will have sufficient power to cause the desired imprint.

Figure 8:
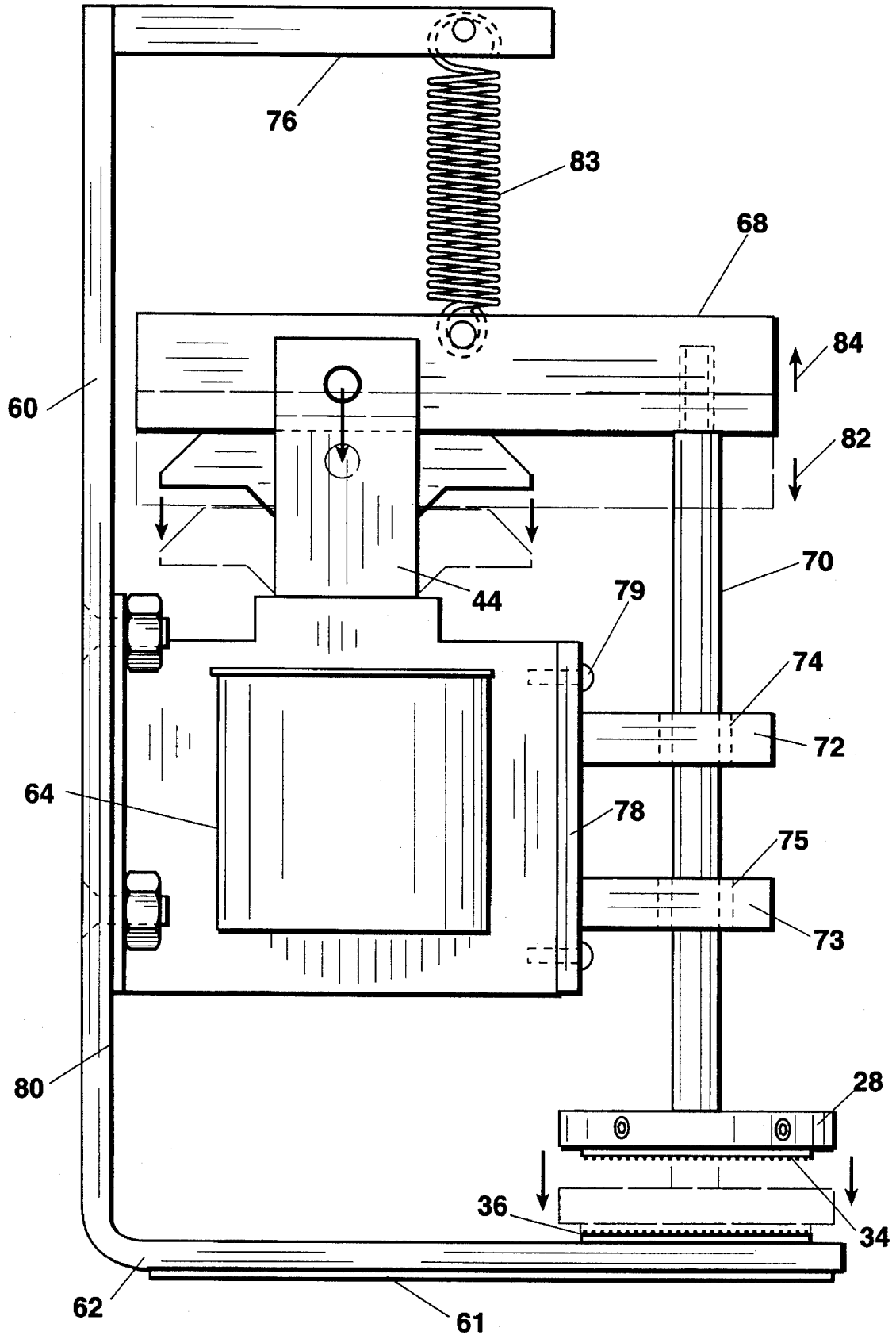
FIG. 8 is a front full face view of another embodiment of the power driven seal device of this invention.

There is no uniform location as to where an impression or seal is to be placed on a document. Some are in the lower left-hand corner, some are in the lower right-hand corner—some even toward the center of the paper. The embodiment shown in FIG. 8 is especially useful for those documents where the seal is to be imprinted in the middle of the document, although the device of FIG. 8 could be used for placing the seal about anywhere. Shown on FIG. 8 is a solenoid 64 supported from frame 60. The extension 44 of the movable core is secured to horizontal drive bar 68. Drive bar 68 is thus supported from movable core in a horizontal position and is secured there in such a position that it moves up and down in the horizontal position shown with the movement of extension 44 of the movable core. On the outer end of drive bar 68 is a drive pin 70. The drive pin 70 is supported from the drive bar 68 by a threaded connection or any other means, such as by welding or pinned. Thus the drive pin 70, through its connection to drive bar 68, also follows up and down the movement of extension 44 of the movable core. Drive pin 70 proceeds downwardly through holes in guide bars 72 and 73. The holes are provided with bushings 74 and 75 so as to reduce the friction as the drive pin moves up and down through that hole in a guiding manner. Guide bars 72 and 73 are secured to or made integral with plate 78 which is secured to the solenoid housing by bolts 79. At the lower end of drive pin 70 is provided a die holder and splash very much like the ones described in connection with FIG. 1. Shown thereon is the die holder 28, die 34, splash 36, which is supported on bottom frame support 62. A cushioned pad 61 is provided on the bottom of base 62. The return means for lifting die 28 includes a spring 83 supported from support 76 which is supported from the frame 60. The lower end of return spring 83 is attached to drive bar 68 in its approximate center. This positioning gives good balancing of the upward force of the return spring 83. The solenoid 64 is arranged such that when it is energized, the solenoid movable core moves downwardly in the embodiment shown in FIG. 8, which is in the direction of the arrow 82. When the solenoid is deactivated, the spring 83 causes the solenoid movable core to be moved upwardly in the direction of arrow 84.

In operation, when the drive pin 70 is moved by the activation of solenoid 64, the pin drives the die holder down to the splash plate to form the desired imprint on a piece of paper or document inserted between the die and the splash. This causes spring 83 to be extended. As soon as the solenoid is de-energized, the return spring 83 forces the drive pin 70 back up, which raises the die holder 28 so that the paper can be removed and another sheet inserted when needed.

This power driven seal device of the embodiment shown in FIG. 8 operates essentially the same as the one in FIG. 1.

One inserts the paper between die holder 28 and splash 36 to the position desired. Then, the solenoid is energized, which causes the movable core to move downwardly and cause the imprint to be made on the paper. When the solenoid 64 is de-energized, the return spring forces the die holder 28 upwardly, permitting the paper to be removed. Other means of returning the die 28 to the position shown in FIG. 8 may be used.

While the invention has been described with a certain degree of particularity, it is manifest that many changes may be made in the details of construction without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. A power driven seal device which comprises:

a solenoid having a body and a movable core;

a frame having an upright member and a lateral member;

a drive bar having a first end fixed to the movable core and extending laterally such that said bar moves up and down with movement of said movable core in a direction parallel to the movement of said core, said bar also having an outer end away from said first end;

a die holder;

a drive pin attached to and near the outer end of said drive bar and extending down to and supporting the die holder;

a splash supported on said lateral member of said frame directly beneath said die holder, said die holder and said splash complementing each other such that when moved together they emboss a design on paper;

and biasing means for driving said drive pin in a direction away from said lateral member frame.

2. A power driven seal device as defined in claim 1 in which said biasing means includes a spring supported between said drive bar and said frame for returning said drive pin to an up position.

3. A power driven seal device which comprises:

a frame having a base and an upright member, a solenoid having a housing and a moveable core, said housing supported from said frame;

a die holder including an embossing element;

said die holder having at least two pins extending laterally therefrom;

a drive pin supported from said movable core and movable therewith and positioned in contact with said die holder;

attaching means on the housing of said solenoid;

biasing members connected between each lateral pin and said attaching means;

a splash supported by the bottom of said frame and directly in the path of said die holder such that when said solenoid is energized said drive pin forces said die holder against said splash.

4. A power driven seal device as defined in claim 3, including guide means for guiding said die holder as it is moved by said movable core and in which the biasing means holds the die holder and drive pin together.

5. A power driven seal device as defined in claim 4 in which said die holder has holes therethrough and said guide means include at least two pins supported from said housing and extend through said holes in said die holder and extending only to a position above said splash.

6. A power driven seal device which comprises:

a frame having a base and an upright member, a solenoid having a housing and a moveable core, said housing supported from said frame;

a die holder including an embossing element;

a drive pin supported from said movable core and positioned in contact with said die holder;

attaching means on the housing of said solenoid;

biasing members connected to the die holder and said attaching means urging said die holder toward said housing and holding the die holder in contact with said drive pin;

a splash supported by the bottom of said frame and directly in the path of said die holder such that when said solenoid is energized said drive pin forces said die holder against said splash.

* * * * *